US007886800B2

(12) United States Patent
Skoczylas

(10) Patent No.: US 7,886,800 B2
(45) Date of Patent: Feb. 15, 2011

(54) APPARATUS AND METHOD FOR APPLYING TAPE

(75) Inventor: Ronald Skoczylas, Philadelphia, PA (US)

(73) Assignee: The Trustees of the University of Pennsylvania, Philadelphia, PA (US)

( * ) Notice: Subject to any disclaimer, the term of this patent is extended or adjusted under 35 U.S.C. 154(b) by 1153 days.

(21) Appl. No.: 11/233,361

(22) Filed: Sep. 23, 2005

(65) Prior Publication Data

US 2006/0065346 A1 Mar. 30, 2006

Related U.S. Application Data

(60) Provisional application No. 60/612,671, filed on Sep. 24, 2004.

(51) Int. Cl.
*B32B 37/22* (2006.01)

(52) U.S. Cl. ..... 156/577; 156/579; 242/407.1; 242/574.3

(58) Field of Classification Search ..... 156/577, 156/579; 242/407.1, 574.3
See application file for complete search history.

(56) References Cited

U.S. PATENT DOCUMENTS

| | | | | |
|---|---|---|---|---|
| 681,277 | A * | 8/1901 | Switzer | 56/227 |
| 2,600,840 | A * | 6/1952 | Bruegger | 242/574.3 |
| 2,957,449 | A | 10/1960 | Carmichael | |
| 3,960,643 | A | 6/1976 | Dargitz et al. | |
| 3,964,835 | A * | 6/1976 | Eigenmann | 404/94 |
| 4,089,730 | A * | 5/1978 | Mahn | 156/541 |
| 4,277,035 | A * | 7/1981 | Gaski | 242/404.3 |
| 4,574,030 | A * | 3/1986 | Pilcher | 156/522 |
| 4,648,935 | A | 3/1987 | Brown et al. | |
| 5,114,527 | A | 5/1992 | Stern et al. | |
| 5,520,761 | A | 5/1996 | Kalwara et al. | |
| 5,865,943 | A * | 2/1999 | Marty | 156/577 |
| 5,976,292 | A | 11/1999 | Barksdale et al. | |
| 6,066,227 | A | 5/2000 | Melton et al. | |
| 6,260,599 | B1 | 7/2001 | You | |
| 6,454,856 | B1 | 9/2002 | Jung | |
| 2004/0187432 | A1 | 9/2004 | Robison et al. | |

(Continued)

FOREIGN PATENT DOCUMENTS

| | | |
|---|---|---|
| EP | 0 133 558 | 2/1985 |

(Continued)

OTHER PUBLICATIONS

SecureTAPER—Ergonomic Equipment Carlisle SynTec Incorporated www.carlisle-syntec.com.

(Continued)

*Primary Examiner*—Mark A Osele
(74) *Attorney, Agent, or Firm*—Pearl Cohen Zedek Latzer, LLP; Mark S. Cohen

(57) ABSTRACT

Embodiments of the invention may provide an apparatus and method for applying a tape such as a seam tape onto a surface such as a roof. The apparatus may include one or more supply wheels and a powered or motorized paper or backing wheel having one or more collapsible or moveable paper or backing hinge bars. The hinge bars may be moved to a standing position to wind up paper or backing produced by the supply wheels when the tape is applied onto the surface, and may be moved to a collapsed position to allow the paper or backing be removed from the paper or backing wheel.

20 Claims, 6 Drawing Sheets

U.S. PATENT DOCUMENTS

| | | | | |
|---|---|---|---|---|
| 2004/0188008 | A1 | 9/2004 | Robison et al. | |
| 2005/0051278 | A1 | 3/2005 | Dobson | |
| 2005/0178507 | A1 * | 8/2005 | Hajny et al. | 156/538 |
| 2006/0144512 | A1 * | 7/2006 | Carroll et al. | 156/304.3 |

FOREIGN PATENT DOCUMENTS

| | | |
|---|---|---|
| GB | 342205 | 1/1931 |
| GB | 902252 | 8/1962 |
| GB | 908368 | 10/1962 |
| JP | 11190107 | 7/1999 |
| JP | 2005/042522 | 2/2005 |
| WO | WO 83/00519 | 2/1983 |
| WO | WO 94/14351 | 7/1994 |
| WO | WO 04000060 | 12/2003 |

OTHER PUBLICATIONS

SecureTAPER—English Instructions Carlisle SynTec Incorporated www. carlisle-syntec. com.
SeamROLLER—Ergonomic Equipment Carlisle SynTec Incorporated www.carlisle-syntec.com.
Correction Tapes and BIC Wite-Out WWW BICWORLD.COM.

* cited by examiner

APPARATUS AND METHOD FOR APPLYING TAPE

CROSS-REFERENCE TO RELATED APPLICATION

The present application claims priority from U.S. Provisional Patent Application U.S. Ser. No. 60/612,671, filed Sep. 24, 2004 and entitled "Seam Wheel", the disclosure of which is incorporated herein by reference in its entirety.

FIELD OF THE INVENTION

The present invention relates generally to apparatuses and methods for applying tape onto a surface, more particularly, to for example a device that applies seam tape onto a surface of roofing material such as roofing membrane.

BACKGROUND OF THE INVENTION

When applying seam tape onto a surface of roofing material, a common problem is the formation of a wave of excess paper or backing in front of the tool that applies the tape. The paper or backing, which may become an obstacle to applying the tape if being left free and unattended, may be for example a lining peeled off or separated from the tape. This excess paper or backing may be one of the many reasons why a job of laying down or applying seam tape is often performed by two or more roofers.

SUMMARY OF THE INVENTION

Some embodiments of the present invention may provide an apparatus for applying a tape, for example, a seam tape, onto a surface, for example, a roof although other embodiments may operate on other surfaces with other types of tape. An apparatus according to some embodiments may include a set of supply wheels (where set can include one) and a typically motorized or powered paper or backing wheel having one or more moveable or collapsible paper or backing hinge bars, wherein the paper or backing wheel is to wind up paper or backing produced by the supply wheels when applying the tape onto the surface. Typically, the paper or backing is attached to an adhesive side of the tape, and is taken off when the tape is applied to the surface. According to one embodiment, the supply wheel or wheels may be called a seam wheel or seam wheels. According to another embodiment, the supply wheel or wheels may be called a rubber wheel or rubber wheels. Other terms may be used.

According to one embodiment, the paper or backing hinge bars may be movable to a standing position to wind up paper or backing produced when the tape is applied onto the surface, and may be moveable to a collapsed position to allow paper or backing be removed from the paper or backing wheel.

According to one embodiment, the paper or backing wheel may be directly mounted on a rotating shaft of a motor or other powering device.

According to another embodiment, the paper or backing wheel may be engaged with the supply wheels through a pulley system that may include one or more pulleys.

According to yet another embodiment, the paper or backing wheel may be engaged with a drive wheel through a pulley system and the drive wheel may be operated by a motor. Devices other than a motor may be used for powering the paper or backing wheel through or without through the drive wheel.

According to one embodiment, one of the supply wheels may be an end cap that is removable from a shaft connecting the set of supply wheels, and the end cap is to be engaged with the shaft through a tension hinge lock.

According to another embodiment, supply wheels of different sizes may be used.

According to yet another embodiment, the distance between the supply wheels may be adjusted.

According to one embodiment, the tape may include a seam tape.

Some embodiments of the present invention may further provide a support bar to rotatably engage with one of the supply wheels at a first end, to rotatably engage with the paper or backing wheel at a desired distance from the first end, and to engage with an extension pole at a second end.

According to one embodiment, the distance of the paper or backing wheel from one of the supply wheel may be adjustable along the support bar.

According to another embodiment, the support bar may engage with one of the supply wheel and the paper or backing wheel through a quick release mechanism that includes for example threaded ball-bearings.

According to one embodiment, the extension pole may be slidably retractable from the support bar and may include at least a plug and clip-on switch to engage electrically with the support bar, wherein the support bar may include at least a tension lock ring at the second end to secure the extension pole.

Some embodiments of the present invention may further provide a mechanism which may include one or more tension clamps. The tension clamps may be attached to the support bar to hold a motor or powering device.

Some embodiments of the present invention may provide a method for applying a tape for example a seam tape onto a surface for example a roof. A method according to one of the embodiments of the present invention may include driving a powering device, such as, a motor operated, for example, by a battery, to rotate a paper or backing wheel. The paper or backing wheel is to wind up paper or backing produced by a set of supply wheels when applying the tape onto the surface.

Some embodiments of the present invention may further provide a method of actuating one or more paper or backing hinge bars on the paper or backing wheel to a standing position to wind thereon the paper produced.

Some embodiments of the present invention may further provide a method of actuating the paper hinge bars to a collapsed position to remove the paper being wound on the paper or backing wheel.

According to one embodiment, rotating the paper or backing wheel may include rotating the paper or backing wheel through a pulley system.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

Figure 1A:
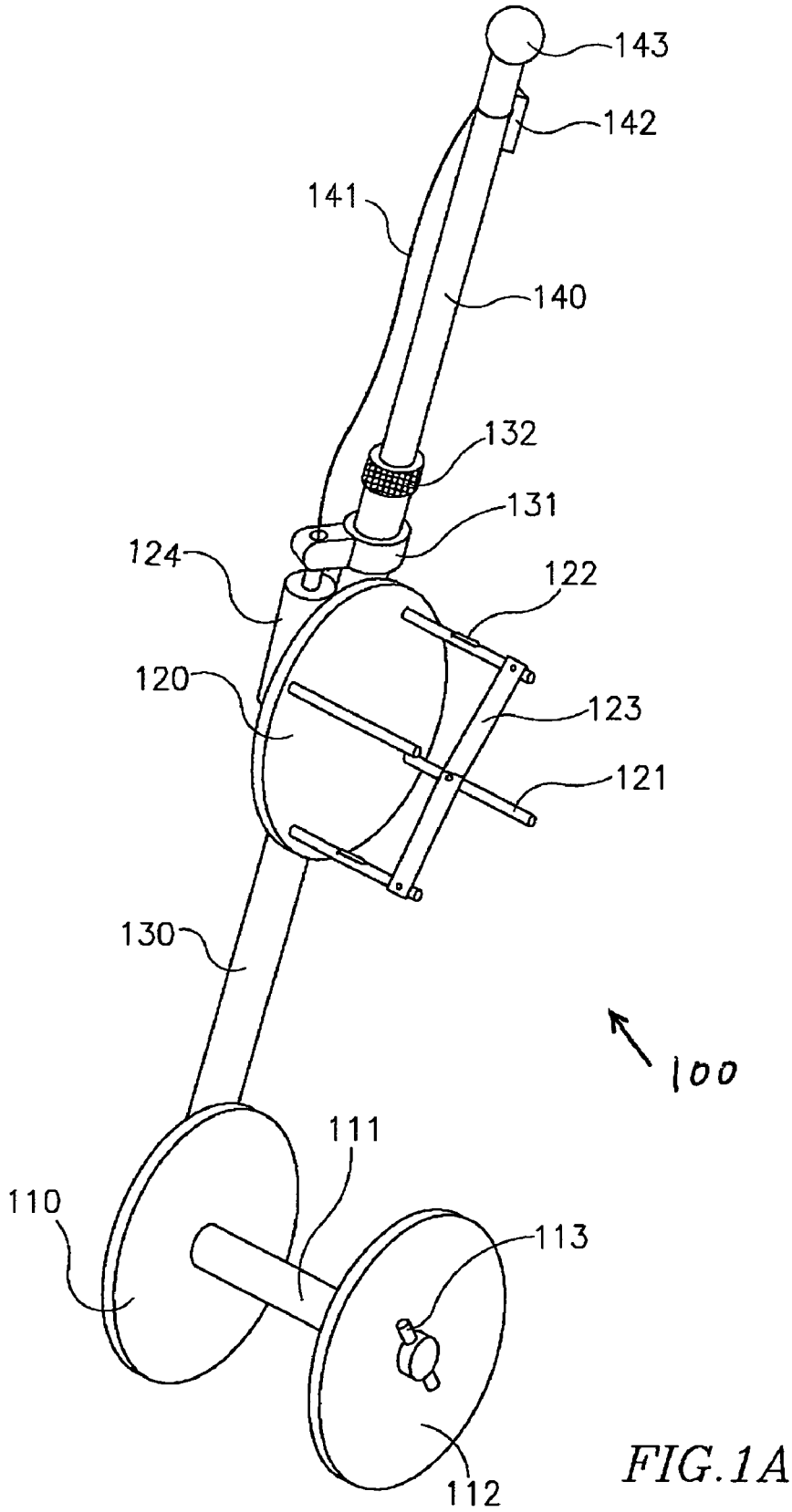
FIGS. 1A-1D are simplified illustrations of an apparatus adapted to applying a tape onto a surface in accordance with one embodiment of the invention.

It will be appreciated that for simplicity and clarity of illustration, elements shown in the drawings have not necessarily been drawn accurately or to scale. For example, the dimensions of some of the elements may be exaggerated relative to other elements for clarity and/or several physical components may be included in one functional block or element. Further, where considered appropriate, reference numerals may be repeated among the drawings to indicate corresponding or analogous elements.

DETAILED DESCRIPTION OF THE INVENTION

In the following detailed description, numerous specific details are set forth in order to provide a thorough understanding of the invention. However, it will be understood by those of ordinary skill in the art that the present invention may be practiced without these specific details. In other instances, well-known methods, procedures, components and circuits may not have been described in detail so as not to obscure the present invention.

FIGS. 1A-1D are simplified illustrations of an apparatus for applying a tape onto a surface according to one embodiment of the invention.

Figure 1B:
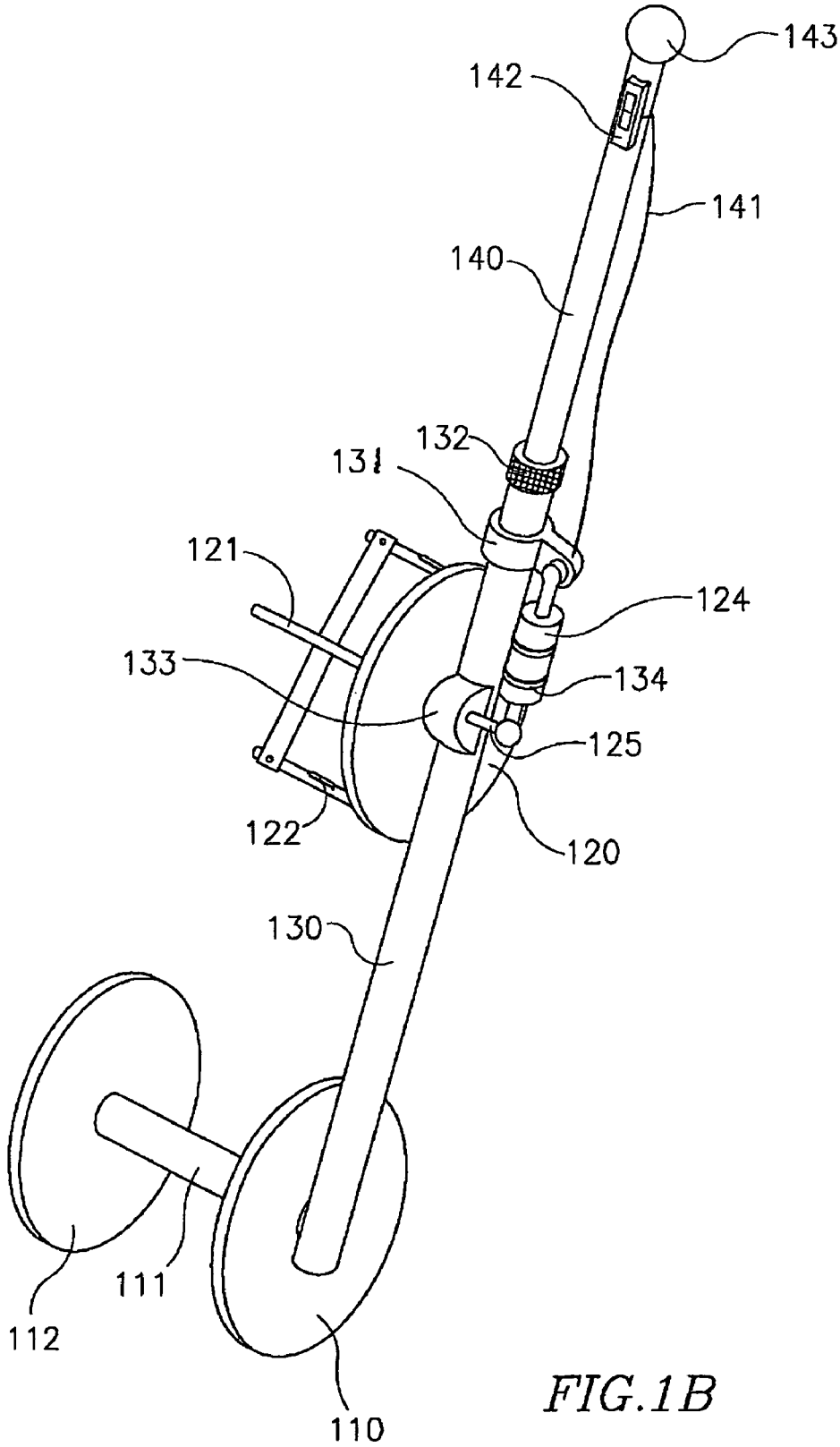
Figure 1C:
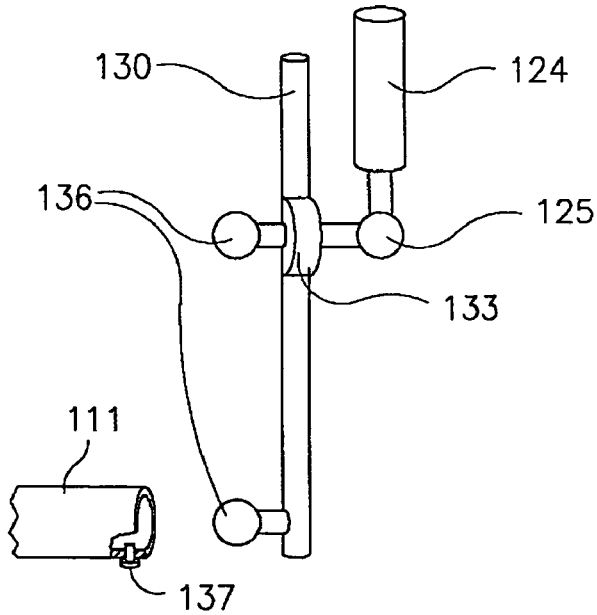

Apparatus 100, as shown in FIG. 1A, may be adapted to apply a tape, e.g., a seam tape, onto a surface, e.g., a roof. However, other types of tape may be used and the tape may be applied to other surfaces. The tape typically has a backing, lining or paper over an adhesive side of the tape, the backing, lining or paper being removed prior to applying the tape. Apparatus 100 may include a set or a pair of supply wheels 110 and 112 and a paper or backing wheel 120, separated by a desired distance along a support bar 130. Other numbers of supply wheels may be used. According to one embodiment of the invention, the pair of supply wheels 110 and 112 may be referred to collectively as a supply wheel or a seam wheel. A shaft 111, whereon supply wheels 110 and 112 may be rotatably mounted, may be attached or fixed in a generally perpendicular position to a first end of support bar 130. The attachment of shaft 111 to support bar 130 may be through for example a quick release mechanism 137 that may include, for example, threaded ball-bearing 136, grease, screws, etc., as shown in FIG. 1C.

Supply wheels 110 and 112 may be separated by a distance equal to the length of shaft 111, and the length of shaft 111 may be adjusted or varied by a user, for example through replacement of shaft 111, from 6 inches, 9 inches, 12 inches, to 24 inches, or other suitable lengths to accommodate installation of tape rolls of different widths. Supply wheels 110 and 112, on one side that contacts the seam tape when the tape is installed, may be threaded so that the roll of seam tape and supply wheels 110 and 112 may rotate together. Supply wheels 110 and 112 may have same or different sizes and the diameters of supply wheels 110 and/or 112 may include, for example, 6 inches, 9 inches, or 12 inches, or other suitable dimensions.

One of the supply wheels, for example supply wheel 112 may be removable from shaft 111 to allow the installation of a roll of tape, such as seam tape, onto shaft 111. Supply wheel 112 may be locked onto shaft 111 to hold the roll of tape firmly in place. A tension hinge lock 113 may be used to lock supply wheel 112 onto shaft 111. Tension hinge lock 113 may be engaged with and be part of shaft 111. For this reason, supply wheel 112 may also be referred to hereinafter as an end cap or an end cap wheel.

Paper or backing wheel 120 may be mounted, in the generally same orientation as supply wheels 110 and 112, rotatably to a shaft 133. Shaft 133 may be located at, for example, one-half to two-third of the length of support bar 130 from its first end. However, other positions may be used. For example, shaft 133 may be fixed according to one embodiment, or may be adjustable up and down along support bar 130 according to another embodiment. By choosing a desired distance between supply wheels 110 and 112 and paper or backing wheel 120, tension of a belt 235 engaging supply wheel 210 and paper or backing wheel 220 may be adjusted as described in detail below with reference to FIG. 2. Support bar 130 may have a length such as, for example, 2 feet, 3 feet and/or 4 feet. However, other lengths may be used.

The mounting of paper or backing wheel 120 to shaft 133 may be through quick release mechanism 137, similar to the mounting of shaft 111 to support bar 130. Shaft 133 may generally be in a perpendicular position to support bar 130, as shown in FIG. 1B-1D, and be arranged such as to accommodate the installation of a powering device as described below in detail.

Figure 1D:
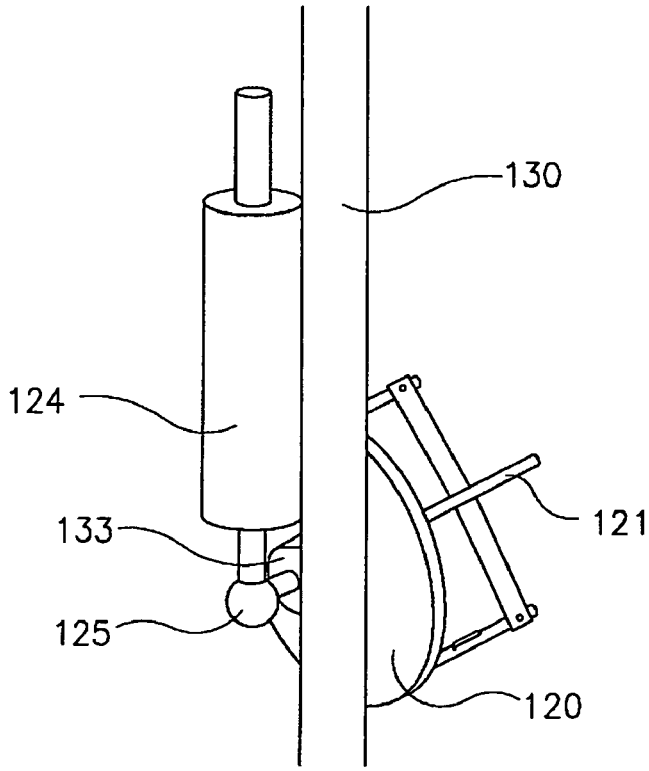

According to one embodiment of the invention, shaft 133 may be adapted to engage a powering device, such as a suitable motor 124 having a rotational driving force through a driving shaft 125 as shown in FIG. 1D, with paper or backing wheel 120. For example, the engagement of shaft 125 with paper or backing wheel 120 may be through a threaded hole in the center of shaft 133. Other motors or power sources may be used. Motor 124, preferably battery-operated, may cause paper or backing wheel 120 to rotate. One example of a battery-operated motor may be an angle drill, with keyless chuck, that may be generally available from a hardware store. A bracket which may include one or more tension clamps 134 may be used to secure motor 124 to support bar 130.

According to one illustrative embodiment of the invention, paper or backing wheel 120 may include one or more (for example, four), collapsible paper or backing hinge bars 121 with one or more engagement bars 123. The engagement bars 123 may hold paper or backing hinge bars in place in a standing position. The paper or backing hinge bars 121 may be welded into place, or may be attached in other ways such as by hinges, or may be manufactured integrally, along the perimeter of paper or backing wheel 120 although positions other than perimeter of paper or backing wheel 120 are also possible. The paper or backing hinge bars 121 may be movable to a first position, referred to herein as a standing position, that may be for example perpendicular, or substantially perpendicular, to the plane of paper or backing wheel 120 to allow paper, backing or lining to be rolled thereon. The paper, backing or lining may be peeled off or separated from a tape, for example a seam tape. In a second position, referred to herein as a collapsed position, the paper or backing hinge bars 121 may be moved to an at least partially folded down position where hinge bars 121 move or fold inward towards the center of the paper or backing wheel 120, so that the roll of paper, backing or lining on the paper or backing hinge bars 121 may be taken off easily from the paper or backing wheel 120. One or more spring paper clips 122, which may or may not be attached to paper or backing hinge bar 121, may be used to help holding the paper, backing or lining. Other holders may be used.

As a seam tape is laid down or applied to the surface of a roof, excess paper, backing or lining being peeled off or separated from the seam tape may be a nuisance. According to one embodiment of the invention, paper or backing wheel 120 may wrap the excess paper, backing or lining around hinge bars 121 while supply wheels 110 and 112 apply the tape onto the roof Paper or backing wheel 120 may turn at a constant speed, which may be adjustable, for example, through adjusting the rotating speed of motor 124.

According to another embodiment of the invention, paper or backing wheel 120, which is powered or driven by motor 124, may turn only at a speed at which the seam tape is being applied onto the surface by supply wheels 110 and 112. As a result, the rotating speed of motor 124 may be limited by the moving speed of supply wheels 110 and 112 along the surface where tape is applied. Supply wheels 110 and 112 and paper or backing wheel 120 may work together like a pulley system. Paper or backing wheel 120 may also include one or more spring paper clips 122 as described above. Paper, backing or lining, peeled off or separated from the tape, may be initially held in place by clips 122 that may be attached to hinge bars 121. As excess paper is generated from the seam tape, the paper is wrapped around the paper or backing hinge bars 121 until the process of laying down seam tape is finished, or a large amount of paper or backing has been accumulated.

Support bar 130 may engage with an extension pole 140 at its second end. Extension pole 140 may be slidably retractable from support bar 130 and may include at least one retractable cord box 131 with plug and clip-on switch attached to support bar 130. Support bar 130, at its second end, may include a tension lock ring 132 to secure extension pole 140.

Extension pole 140 may include a threaded knob handle 143 at its far end that is not engaged with support bar 130, and a clip-on switch 142 located at a desired position easily accessible by a user holding knob handle 143. Clip-on switch 142 may be electrically connected to motor 124 through, for example, a power cord 141 and retractable cord box 131 with plug and clip-on switch. With the use of clip-on switch 142, together with power cord 141 and retractable cord box 131 with plug and clip-on switch, a user, particularly a tall user, may be able to switch motor 124 or other power source on and off, therefore control the rotation of paper or backing wheel 120 as needed while at the same time be able to comfortably apply pressure to the roof surface to which the seam tape is applied.

Apparatus 100, or at least some components, may be made of lightweight materials, such as, for example, heavy gauge aluminum. However, the invention is not limited in this respect and other materials may be used.

Figure 2:
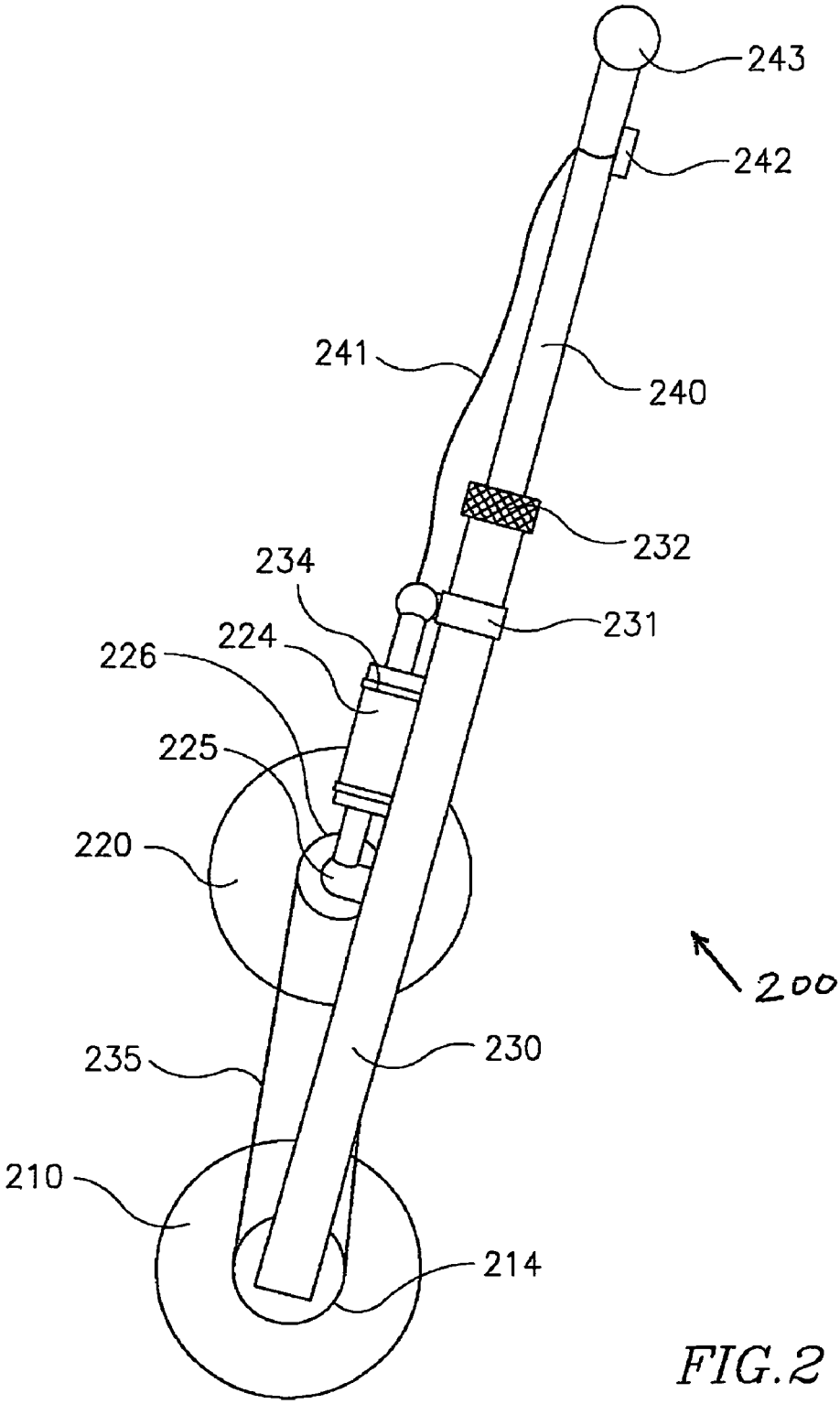
FIG. 2 is a simplified illustration of an apparatus adapted to applying a tape onto a surface in accordance with another embodiment of the invention.

FIG. 2 is a simplified illustration of an apparatus adapted for applying a tape onto a surface according to illustrative embodiment of the invention.

Apparatus 200, as shown in FIG. 2, may have a similar configuration to apparatus 100 as described above with reference to FIG. 1A-1D. For example, apparatus 200 may include a pair of supply wheels 210, and a paper or backing wheel 220 separated by a desired distance along a support bar 230. According to one embodiment of the invention, supply wheels 210 may be rotationally engaged with paper or backing wheel 220 through a pulley system. A pulley system, as described in this application, may include one or more pulleys. For example, the pulley system in FIG. 2 may include a first pulley 214, which may be attached to and be part of supply wheels 210, and a second pulley 226, which may be attached to and be part of paper or backing wheel 220, and an endless belt 235 engaging pulleys 214 and 226 under a desired tension.

According to one embodiment of the invention, paper or backing wheel 220 and pulley 226 may be driven by for example a battery operated motor 224 as shown in FIG. 2. The rotational motion of pulley 226 may be transferred through belt 235 to pulley 214, causing pulley 214 to rotate in tandem with pulley 226. Since pulley 214 is attached to supply wheels 210, supply wheels 210 may therefore rotate in tandem with paper or backing wheel 220. When a seam tape is applied to or laid down on the surface of for example a roof, the rotational motion of supply wheels 210 may help paper or backing wheel 220 wind up the excess paper or backing produced by the roll of seam tape installed between the two supply wheels 210.

According to one embodiment of the invention, a motor 224 may be used to drive pulley 226 and engage paper or backing wheel 220 to wind up paper, backing or lining produced during application of the seam tape. Supply wheels 210 may be engaged into a rotational motion through belt 235 of the pulley system. According to another embodiment of the invention, motor 224 may not be used to drive pulley 226. The rotational motion of supply wheels 210 during the application of seam tape may drive paper or backing wheel 220, through belt 235, into rotational motion so as to wind up the excess paper or backing peeled off or separated from the seam tape.

Figure 3:
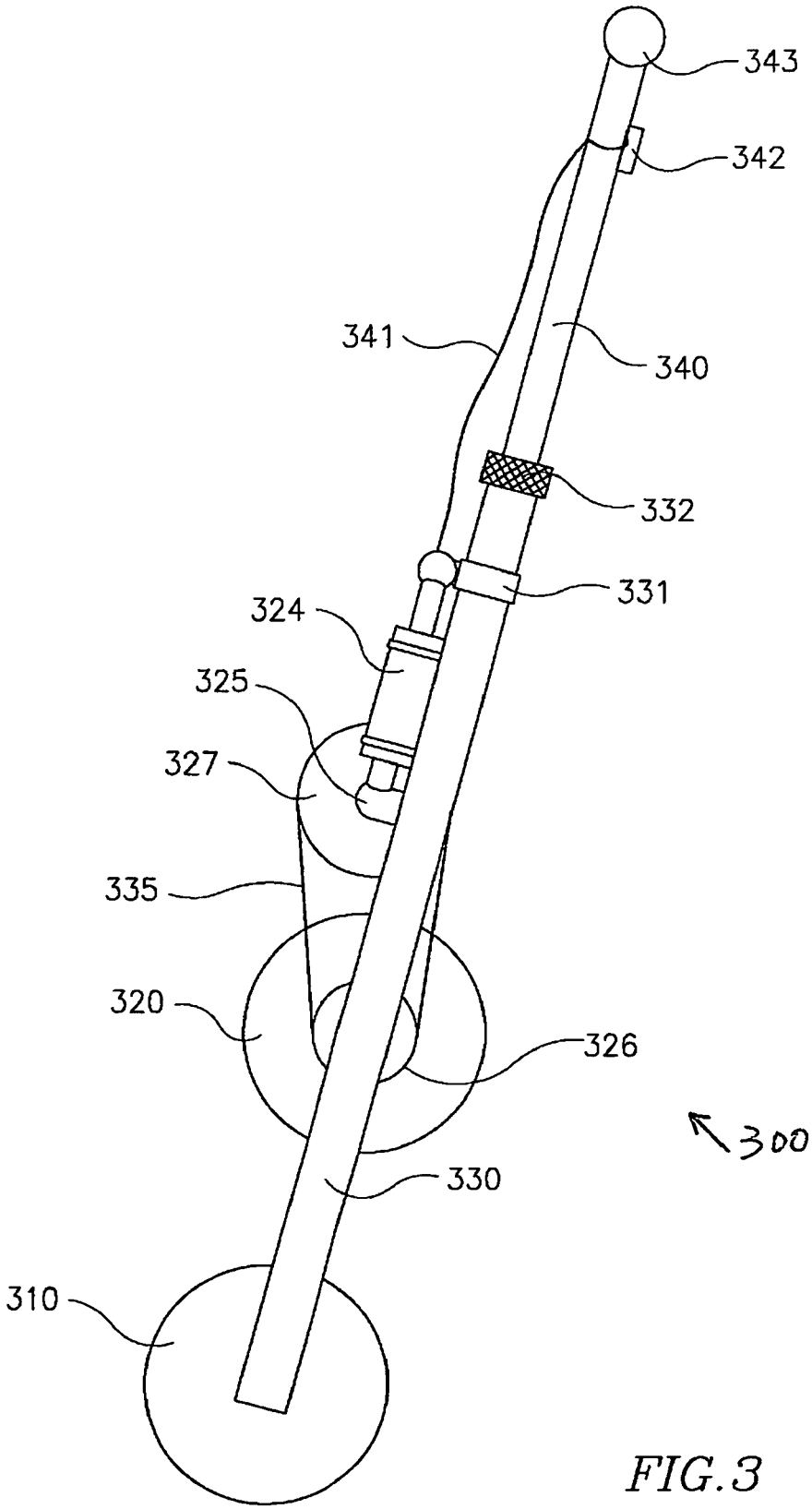
FIG. 3 is a simplified illustration of an apparatus adapted to applying a tape onto a surface in accordance with yet another embodiment of the invention.

FIG. 3 is a simplified illustration of an apparatus adapted for applying a seam tape onto a surface according to illustrative embodiment of the invention.

Apparatus 300, as shown in FIG. 3, may include a set or a pair of supply wheels 310 and a paper or backing wheel 320 separated by a desired distance along a support bar 330 which is similar to apparatus 100 shown in FIG. 1. According to one embodiment of the invention, a pulley 326 may be attached or fixed to the paper or backing wheel 320. Additionally, apparatus 300 may include a drive wheel 327, which is directly driven by a power device, for example a battery operated motor 324. Other types of powering devices may be used. Pulley 326 on paper or backing wheel 320 may be rotationally connected to pulley 327 through an endless belt 335.

According to one embodiment of the invention, motor 324 may power drive wheel 327 to rotate and, through belt 335 and pulley 326 attached to paper or backing wheel 320, to engage paper or backing wheel 320 into a rotational motion. During the process of applying a seam tape, the rotational motion of paper or backing wheel 320 may result in the excess paper or backing produced by the tape being wound up at paper or backing wheel 320. The paper or backing wheel 320, motorized by drive wheel 327 through belt 335, may rotate at a speed sufficient fast to pick up the excess paper produced. Since paper or backing wheel 320 is engaged, through the backing or lining of the seam tape, with supply wheels 310, the rotational speed of paper or backing wheel 320 may be determined by the speed of the seam tape being applied to the surface of roof. According to another embodiment, the rotational speed of motor 324 may be limited by the tension of endless tape 335.

Figure 4:
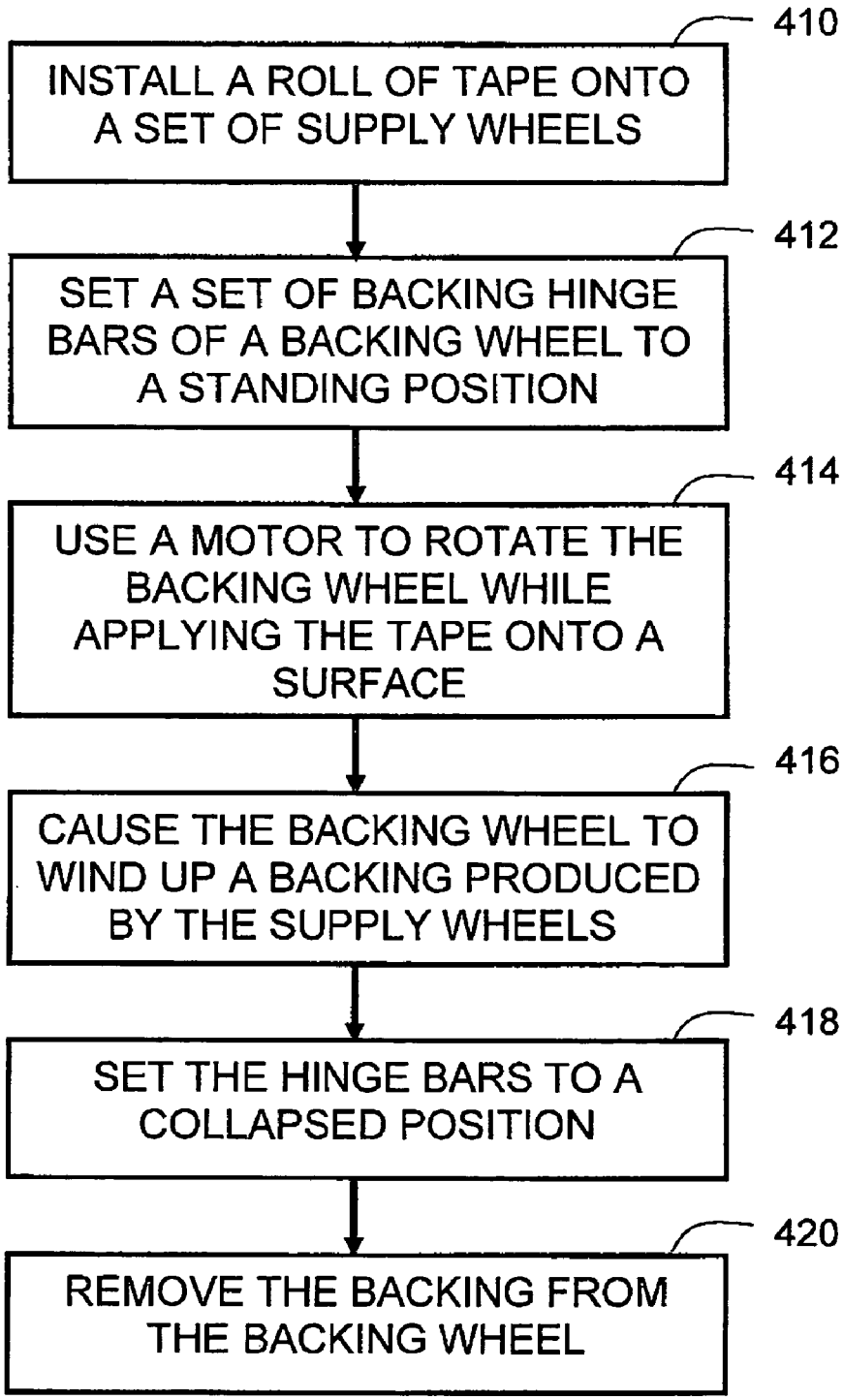
FIG. 4 is a simplified flowchart illustration of a method for applying a tape onto a surface in accordance with one embodiment of the invention.

FIG. 4 is a simplified flowchart illustration of a method for applying tape such as seam tape onto a surface in accordance with one embodiment of the invention.

A user may apply a tape, for example, a seam tape, onto a surface, for example, a roof according to one of the embodiments of the invention as described below. As indicated at operation 410, the user may start with installing a roll of seam tape that has with backing or lining onto a set of supply wheels of an apparatus.

The user may then position a set of, for example four, paper or backing hinge bars of a paper or backing wheel of the apparatus into a first position, which may be a standing position as described above in FIG. 1, as indicated at operation 412.

In operation 414, a motor may operate to rotate the paper or backing wheel while the seam tape is being applied or being laid down on the surface of the roof.

In operation 416, excess paper, backing or lining separated from the tape and produced by the supply wheels may be wound up by the paper or backing wheel.

During the course or at the end of the process of applying the seam tape, when the paper or backing wheel has accumulated enough paper, backing or lining, the paper or backing hinge bars may be set to a collapsed position by the user, as indicated at operation 418.

In operation 420, after the paper or backing hinge bars are moved from their standing position, the paper, backing or lining is removed from the paper or backing wheel.

While certain features of the invention have been illustrated and described herein, many modifications, substitutions, changes, and equivalents may occur to those of ordinary skill in the art. It is, therefore, to be understood that the appended claims are intended to cover all such modifications and changes as fall within the true spirit of the invention.

What is claimed is:

1. An apparatus for applying a tape onto a surface, the apparatus comprising:

a set of supply wheels; a motorized backing wheel having a plurality of collapsible backing hinge bars, wherein the backing wheel is to wind up a backing produced by the supply wheels when applying the tape onto the surface; and a mechanism to adjust the distance of the backing wheel from the supply wheels.

2. The apparatus of claim 1, wherein the backing hinge bars are movable to a standing position to wind up the backing when applying the tape onto the surface and moveable to a collapsed position to allow the backing be removed from the backing wheel.

3. The apparatus of claim 1, wherein the backing wheel is mounted on a rotating shaft driven by a motor.

4. The apparatus of claim 1, wherein the backing wheel is engaged with the supply wheel through a pulley system.

5. The apparatus of claim 1, wherein the backing wheel is engaged with a drive wheel through a pulley system, the drive wheel being operated by a motor.

6. The apparatus of claim 1, wherein one of the supply wheels is an end cap removable from a shaft connecting the supply wheels, the end cap to be engaged with the shaft through a tension hinge lock.

7. The apparatus of claim 1, wherein the supply wheels are separated by a desired distance.

8. The apparatus of claim 1, wherein the tape comprises a seam tape.

9. The apparatus of claim 1, said mechanism comprising a support bar to rotatably engage with at least one of the supply wheels at a first end; to rotatably engage with the backing wheel at a desired distance from the first end; and to engage with an extension pole at a second end.

10. The apparatus of claim 9, wherein the distance of the backing wheel from the supply wheels is adjustable along the support bar.

11. The apparatus of claim 10, wherein the support bar engages with the supply wheel and the backing wheel through a quick release mechanism comprising threaded ball-bearings.

12. The apparatus of claim 11, wherein the extension pole is slidably retractable from the support bar and includes at least a plug and clip-on switch to engage with the support bar, and wherein the support bar includes at least a tension lock ring at the second end to secure the extension pole.

13. The apparatus of claim 11, further comprising a bracket including at least one tension clamp, the bracket being attached to the support bar to hold a motor.

14. A method of applying a tape having a backing onto a surface, the method comprising driving a motor to rotate a backing wheel to wind up a backing produced by one or more supply wheels when applying the tape onto the surface.

15. The method of claim 14, comprising actuating one or more backing hinge bars on the backing wheel to a standing position to wind thereon the backing produced.

16. The method of claim 15, comprising actuating the backing hinge bars to a collapsed position to remove the backing being wound on the backing wheel.

17. The method of claim 16, wherein rotating the backing wheel comprises rotating the backing wheel through a pulley system.

18. An apparatus for applying a seam tape onto a roof, the apparatus comprising:

one or more supply wheels;

a powered paper or backing wheel having a set of collapsible paper hinge bars, wherein the paper or backing wheel is to wind up excess paper peeled from the tape by the supply wheels when the tape is applied onto the surface of roof; and a mechanism to adjust the distance of the paper or backing wheel from the supply wheels.

19. The apparatus of claim 18, wherein the backing hinge bars have a first position to wind up the excess paper when applying the tape onto the roof, and a second position to allow the excess paper be removed from the paper or backing wheel.

20. The apparatus of claim 18, wherein the paper or backing wheel is caused to rotated by a motor to wind up the excess paper.

* * * * *